US011854505B2

(12) United States Patent
Zhang

(10) Patent No.: US 11,854,505 B2
(45) Date of Patent: Dec. 26, 2023

(54) DISPLAY COMPENSATION METHOD AND DEVICE, AND DISPLAY PANEL

(71) Applicants: HUIZHOU CHINA STAR OPTOELECTRONICS DISPLAY CO., LTD., Guangdong (CN); TCL CHINA STAR OPTOELECTRONICS TECHNOLOGY CO., LTD., Guangdong (CN)

(72) Inventor: Yonglei Zhang, Guangdong (CN)

(73) Assignees: HUIZHOU CHINA STAR OPTOELECTRONICS DISPLAY CO., LTD., Guangdong (CN); TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/413,990

(22) PCT Filed: May 31, 2021

(86) PCT No.: PCT/CN2021/097095
§ 371 (c)(1),
(2) Date: Oct. 22, 2022

(87) PCT Pub. No.: WO2022/217710
PCT Pub. Date: Oct. 20, 2022

(65) Prior Publication Data

US 2022/0392417 A1 Dec. 8, 2022

(30) Foreign Application Priority Data

Apr. 13, 2021 (CN) ..... 202110394911.7

(51) Int. Cl.
*G09G 3/36* (2006.01)

(52) U.S. Cl.
CPC ... *G09G 3/3607* (2013.01); *G09G 2320/0233* (2013.01)

(58) Field of Classification Search
CPC ... G08B 21/0446; G08B 25/016; G08B 25/10
See application file for complete search history.

(56) References Cited

U.S. PATENT DOCUMENTS 11,164,543 B1 * 11/2021 Gao ..... G09G 3/2074
2019/0206341 A1 * 7/2019 Liao ..... G02F 1/1343
(Continued)

FOREIGN PATENT DOCUMENTS

CN 107731149 A 2/2018
CN 108133692 A 6/2018
(Continued)

*Primary Examiner* — Van N Chow
(74) *Attorney, Agent, or Firm* — Mark M. Friedman

(57) ABSTRACT

A display compensation method and device, and a display panel are disclosed. The display panel includes a plurality of pixel units each including a plurality of subpixels. The display compensation method includes obtaining original grayscale values of sub-images included in a pending image corresponding to the pixel units, and determining the sub-images whose original grayscale value is less than or equal to a grayscale threshold value as a target sub-image. The target sub-image is displayed through each of the subpixels of a target pixel unit corresponding to the target sub-image, and each of the subpixels of the target pixel unit has a grayscale value equal to a grayscale value of the target sub-image.

13 Claims, 2 Drawing Sheets

(56) References Cited

U.S. PATENT DOCUMENTS

| | | | | |
|---|---|---|---|---|
| 2019/0221175 | A1* | 7/2019 | Li | G09G 3/3614 |
| 2020/0020285 | A1* | 1/2020 | Shan | G09G 3/3426 |
| 2020/0020286 | A1* | 1/2020 | Shan | G09G 3/3607 |
| 2020/0090604 | A1* | 3/2020 | Chen | G09G 3/36 |
| 2020/0118513 | A1* | 4/2020 | Chen | G09G 3/3696 |
| 2020/0152143 | A1* | 5/2020 | Chen | G09G 3/3648 |
| 2020/0168145 | A1* | 5/2020 | Chen | G09G 3/3648 |
| 2021/0012729 | A1* | 1/2021 | Kang | G09G 3/3413 |
| 2021/0327331 | A1* | 10/2021 | Zhang | G09G 3/2007 |

FOREIGN PATENT DOCUMENTS

| | | | |
|---|---|---|---|
| CN | 109461419 | A | 3/2019 |
| CN | 109493800 | A | 3/2019 |
| CN | 112180630 | A | 1/2021 |

* cited by examiner

DISPLAY COMPENSATION METHOD AND DEVICE, AND DISPLAY PANEL

CROSS REFERENCE TO RELATED APPLICATIONS

This application claims priority to China Patent Application No. 202110394911.7, filed Apr. 13, 2021, titled "DISPLAY COMPENSATION METHOD AND DEVICE, AND DISPLAY PANEL," the disclosure of which is incorporated herein by reference in its entirety.

BACKGROUND OF INVENTION

1. Field of Invention

The present invention relates to a technical field of displays, and more particularly to a display compensation method and device, and a display panel.

2. Related Art

Large viewing angle displays are an important research direction of display technologies. At present, in liquid crystal display devices, using view angle compensation (VAC) technologies to compensate visual angles of the liquid crystal display devices, have become a vital means to achieve large viewing angles. The key to the VAC technologies is to use combinations of high grayscale pixels and low grayscale pixels to achieve an intermediate grayscale image display. This method has obvious advantages for improving display viewing angles.

However, when display devices are performing screen display, there will be brightness changes in different frames of images. Since the VAC technologies use combinations of high grayscale pixels and low grayscale pixels to display brightness of an intermediate grayscale image, when a next frame of an image has a higher grayscale than a current frame of an image, a grayscale value of high grayscale brightness of the current frame will be greater than a grayscale value of the next frame, causing display brightness of the next frame to be obscured. Likewise, when a grayscale of the next frame decreases, low grayscale brightness of the current frame will cover the display brightness of the next frame. The above-mentioned two situations will eventually give rise to a problem of image shaking or flickering when the display devices display low grayscale images.

A technical problem of flickering of low grayscale images occurs when current display devices employ the VAC technologies to improve the visual angles of the display devices.

SUMMARY OF INVENTION

An object of the present invention is to provide a display compensation method, a display compensation device, and a display panel to alleviate a technical problem of flickering of low grayscale images in display devices.

The present application provides a display compensation method, employed in a display panel, the display panel comprising a plurality of pixel units each comprising a plurality of subpixels, the display compensation method comprising obtaining original grayscale values of sub-images included in a pending image corresponding to the pixel units; determining the sub-images whose original grayscale value is less than or equal to a grayscale threshold as a first target sub-image; determining the pixel units corresponding to the first target sub-image as a first target pixel unit; and displaying the first target sub-image through each of the subpixels of the first target pixel unit, wherein each of the subpixels of the first target pixel unit has a grayscale value equal to the original grayscale value of the first target sub-image.

In the display compensation method of the present application, after the determining the sub-images whose original grayscale value is less than or equal to a grayscale threshold value as a first target sub-image, the display compensation method further comprises determining the sub-images whose original grayscale value is greater than the grayscale threshold value as a second target sub-image.

In the display compensation method of the present application, after the determining the sub-images whose original grayscale value is greater than the grayscale threshold value as a second target sub-image, the display compensation method further comprises determining the pixel units corresponding to the second target sub-image as a second target pixel unit.

In the display compensation method of the present application, after the determining the pixel units corresponding to the second target sub-image as a second target pixel unit, the display compensation method further comprises displaying the second target sub-image through high grayscale subpixels and low grayscale subpixels included in the second target pixel unit, wherein the high grayscale subpixels each have a grayscale value greater than the original grayscale value of the second target sub-image, and the low grayscale subpixels each have a grayscale value less than the original grayscale value of the second target sub-image.

In the display compensation method of the present application, each of the pixel units comprises four subpixels, and the displaying the second target sub-image through high grayscale subpixels and low grayscale subpixels included in the second target pixel unit further comprises determining two of the subpixels of the second target pixel unit as the high grayscale subpixels; and determining another two of the subpixels of the second target pixel unit as the low grayscale subpixels.

In the display compensation method of the present application, after the determining the sub-images whose original grayscale value is less than or equal to a grayscale threshold value as a first target sub-image, the display compensation method further comprises detecting each of the sub-images of the pending image whose original grayscale value is less than or equal to the grayscale threshold value; and determining the pending image comprising the sub-images each having the original grayscale value less than or equal to the grayscale threshold value as a low grayscale image.

In the display compensation method of the present application, after the determining the pending image comprising the sub-images each having the original grayscale value less than or equal to the grayscale threshold value as a low grayscale image, the display compensation method further comprises displaying the sub-images of the low grayscale image through each of the subpixels of the pixel units corresponding to the low grayscale image, wherein the grayscale value of each of the subpixels of the pixel units is equal to the original grayscale value of a corresponding one of the sub-images of the low grayscale image.

In the display compensation method of the present application, after the determining the sub-images whose original grayscale value is less than or equal to a grayscale threshold value as a first target sub-image, the display compensation method further comprises detecting whether the pending image comprises at least one of the sub-images whose original grayscale value is greater than the grayscale threshold value; and determining the pending image comprising the at least one of the sub-images having the original grayscale value greater than the grayscale threshold value as a high grayscale image.

In the display compensation method of the present application, after the determining the pending image comprising the at least one of the sub-images having the original grayscale value greater than the grayscale threshold value as a high grayscale image, the display compensation method further comprises displaying the sub-images of the high grayscale image through high grayscale subpixels and low grayscale subpixels of the pixel units corresponding to the high grayscale image, wherein the high grayscale subpixels each have a grayscale value greater than the original grayscale value of each of the sub-images of the high grayscale image, and the low grayscale subpixels each have a grayscale value less than the original grayscale value of each of the sub-images of the low grayscale image.

In the display compensation method of the present application, a number of the subpixels of each of the pixel units is four, and the displaying the sub-images of the high grayscale image through high grayscale subpixels and low grayscale subpixels of the pixel units corresponding to the high grayscale image further comprises determining two of the subpixels of each of the pixel units as the high grayscale subpixels; and determining another two of the subpixels of each of the pixel units as the low grayscale subpixels.

In the display compensation method of the present application, the grayscale threshold value is equal to a grayscale value of 16, and the determining the sub-images whose original grayscale value is less than or equal to a grayscale threshold value as a first target sub-image comprises comparing a magnitude relationship between the original grayscale values of the sub-images and the grayscale threshold value; and determining the sub-images whose original grayscale value is less than or equal to the grayscale value of 16 as the first target sub-image.

The present application further provides a display compensation device, used in a display panel, the display panel comprising a plurality of pixel units each comprising a plurality of subpixels, the display compensation device comprising an obtaining module configured to obtain original grayscale values of sub-images included in a pending image corresponding to the pixel units; a first determining module configured to determine the sub-images whose original grayscale value is less than or equal to a grayscale threshold value as a first target sub-image; a second determining module configured to determine any of the pixel units corresponding to the first target sub-image as a first target pixel unit; and a display output module configured to display the first target sub-image through each of the subpixels of the first target pixel unit, wherein each of the subpixels of the first target pixel unit has a grayscale value equal to the original grayscale value of the first target sub-image.

In the display compensation device of the present application, the display compensation device further comprises a detection module configured to detect whether the pending image comprises the sub-images each having the original grayscale value less than or equal to the grayscale threshold value.

In the display compensation device of the present application, the second determining module is further configured to determine any of the pixel units corresponding to the second target sub-image as a second target pixel unit.

In the display compensation device of the present application, the display output module is further configured to display the second target sub-image through high grayscale subpixels and low grayscale subpixels included in the second target pixel unit, wherein the high grayscale subpixels each have a grayscale value greater than the original grayscale value of the second target sub-image, and the low grayscale subpixels each have a grayscale value less than the original grayscale value of the second target sub-image.

In the display compensation device of the present application, a number of the subpixels of each of the pixel units is four, and the display output module is further configured to determine two of the subpixels of the second target pixel unit as the high grayscale subpixels, and to determine another two of the subpixels of the second target pixel unit as the low grayscale subpixels.

In the display compensation device of the present application, the grayscale threshold value is equal to a grayscale value of 16.

The present application further provides a display panel, comprising the aforementioned display compensation device.

In the display panel of the present application, the display compensation device is configured to implement the aforementioned display compensation method.

The present application has advantageous effects as follows: the present application provides a display compensation method, a display compensation device, and a display panel. The display compensation method includes determining sub-images included in a pending image whose original grayscale value is less than or equal to a grayscale threshold value as a target sub-image, displaying the target sub-image through each of subpixels of a target pixel unit corresponding to the target sub-image, and a grayscale value of each of the subpixels of the target pixel unit is equal to an original grayscale value of the target sub-image. The display compensation method provided by the present application sets a grayscale threshold value, so that sub-images whose grayscale value is less than or equal to the grayscale threshold value are directly displayed by subpixels each having a grayscale value equal to an original grayscale value of a corresponding one of the sub-images, thereby eliminating a flicker problem with the display panel when displaying low grayscale images, and improving display quality of the display panel.

BRIEF DESCRIPTION OF DRAWINGS

In order to more clearly illustrate the technical solutions in the embodiments or in prior art, the following will briefly introduce the drawings needed in the description of the embodiments or the prior art. Apparently, the accompanying drawings in the following description show merely some embodiments of the present invention, and those skilled in the art may still derive other drawings from these accompanying drawings without creative efforts.

DESCRIPTION OF PREFERRED EMBODIMENTS

The following embodiments are referring to the accompanying drawings for exemplifying specific implementable embodiments of the present invention. Directional terms described by the present invention, such as upper, lower, front, back, left, right, inner, outer, side, etc., are only directions by referring to the accompanying drawings, and thus the directional terms are used to describe and understand the present invention, but the present invention is not limited thereto.

An embodiment of the present application provides a display compensation method, a display compensation device, and a display panel. The display compensation method is employed by the display panel and includes determining sub-images included in a pending image whose original grayscale value is less than or equal to a grayscale threshold value as a target sub-image, displaying the target sub-image through each of subpixels of a target pixel unit corresponding to the target sub-image, and a grayscale value of each of the subpixels of the target pixel unit is equal to an original grayscale value of the target sub-image. The display compensation method provided by the present application sets a grayscale threshold value, so that sub-images whose grayscale value is less than or equal to the grayscale threshold value are directly displayed by subpixels each having a grayscale value equal to an original grayscale value of a corresponding one of the sub-images, thereby eliminating a flicker problem with the display panel when displaying low grayscale images, and improving display quality of the display panel.

Figure 1:
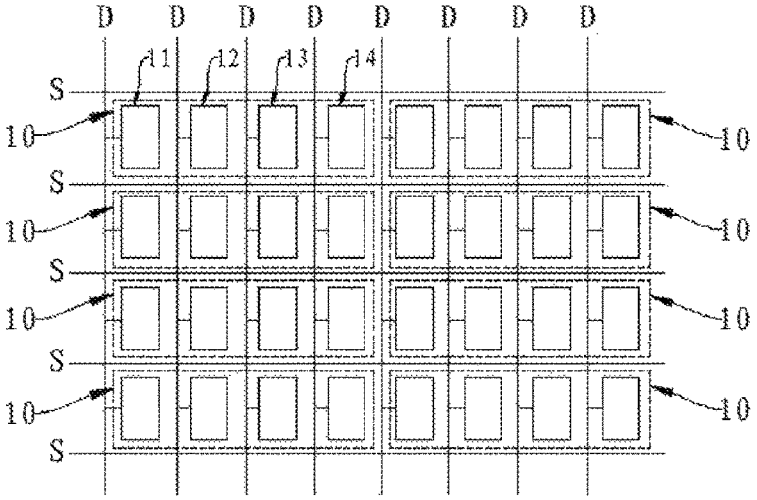
FIG. 1 is a partial schematic view of a display panel provided by an embodiment of the present application.
Figure 2:
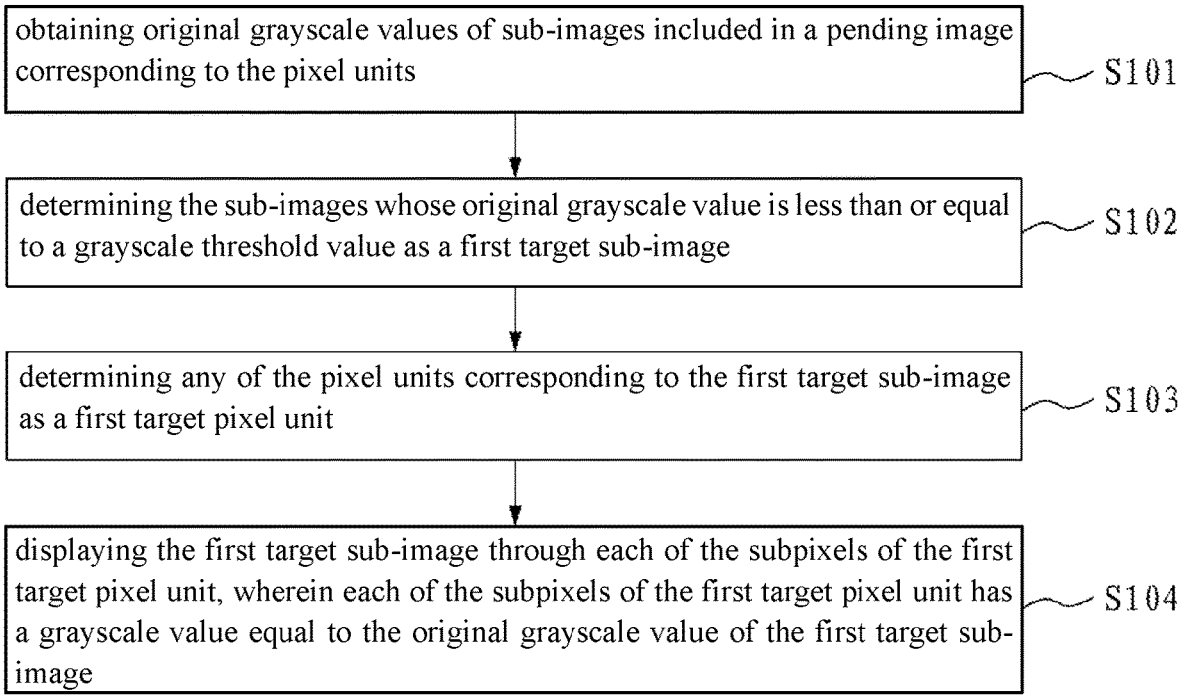
FIG. 2 is a flowchart of a display compensation method provided by an embodiment of the present application.

Please refer to FIGS. 1 and 2. FIG. 1 is a partial schematic view of a display panel provided by an embodiment of the present application, and FIG. 2 is a flowchart of a display compensation method provided by the embodiment of the present application. The display compensation method shown in FIG. 2 can be employed in the display panel shown in FIG. 1 to achieve display of the display panel.

Optionally, the display panel is a liquid crystal display panel. The display panel includes a plurality of data lines D and scan lines S, and the data lines D and the scan lines S can be arranged to be perpendicular to each other. The data lines D and the scan lines S intersect to form a plurality of grid regions, and each of the grid regions is corresponding to a subpixel provided by the display panel.

The display panel includes a plurality of pixel units 10, and each of the pixel units 10 includes the subpixels. For example, each of the pixel units 10 may include a subpixel 11, a subpixel 12, a subpixel 13, and a subpixel 14. Specifically, the pixel units 10 are basic repeating units when the display panel performs screen display. The pixel units 10 perform screen display through each of the subpixels of the pixel units 10. Each of the subpixels of each of the pixel units 10 includes one of the data lines D electrically connected to the subpixel, and is controlled by one of the scan lines S. Therefore, each of the subpixels can independently display brightness of a grayscale value.

The data lines D transmit data signals to the subpixels to enable the subpixels to be positive or negative in polarity. When the data signals transmitted by the data lines D change, polarities of the subpixels will also change correspondingly. The subpixels connected to a same data line D have a same polarity, and the subpixels connected to adjacent two of the data lines can have opposite polarities, respectively. The polarities of the subpixels in the same pixel unit 10 may be same or different.

For example, in a certain frame of an image, the subpixel 11 and the subpixel 13 in the pixel unit 10 both have a positive polarity, and the subpixel 12 and the subpixel 14 both have a negative polarity. In a next frame of an image, the subpixel 11 and the subpixel 13 in the pixel unit 10 both have a negative polarity, and the subpixel 12 and the subpixel 14 both have a positive polarity.

Optionally, during displaying, different subpixels of each of the pixel units 10 may display brightness of same grayscale values or different grayscale values. In view angle compensation (VAC) technologies, part of the subpixels of the pixel units 10 are employed to display high grayscales, and the other part of the subpixels display low grayscales, so that the pixel units 10 as a whole show an intermediate grayscale image. Such technologies can improve visual angles of display panels. For example, in the pixel unit 10, each of the subpixel 11 and the subpixel 12 displays a high grayscale, and each the subpixel 13 and the subpixel 14 display a low grayscale.

Please refer to FIG. 2. The display compensation method provided by an embodiment of the present application can drive the display panel shown in FIG. 1 for display. The display compensation method includes steps as follows:

Step S101: obtaining original grayscale values of sub-images included in a pending image corresponding to the pixel units 10.

The pending image is an image that needs to be displayed on the display panel in a current frame. The pending image is composed of a plurality of sub-images corresponding to the pixel units 10. The original grayscale values of the sub-images are grayscale values of the sub-images to be displayed.

Step S102: determining the sub-images whose original grayscale value is less than or equal to a grayscale threshold value as a first target sub-image.

The grayscale threshold value is a value corresponding to a certain grayscale. The sub-images whose original grayscale value is less than or equal to the grayscale threshold value will show certain low grayscale characteristics. In VAC technologies, the low grayscale sub-images will have a flickering problem.

Optionally, the grayscale threshold value is equal to a grayscale value of 16. Step S102 includes comparing a magnitude relationship between the original grayscale values of the sub-images and the grayscale threshold value; and determining the sub-images whose original grayscale value is less than or equal to the grayscale value of 16 as the first target sub-image.

Step S103: determining any of the pixel units 10 corresponding to the first target sub-image as a first target pixel unit.

The first target pixel unit displays the first target sub-image and exhibits low grayscale characteristics.

Step S104: displaying the first target sub-image through each of the subpixels of the first target pixel unit, wherein each of the subpixels of the first target pixel unit has a grayscale value equal to the original grayscale value of the first target sub-image.

That is, the first target sub-image having the original grayscale value less than the grayscale threshold value is not performed with viewing angle adjustment through the VAC technologies, but the grayscale value of each of the subpixels is directly set to be equal to the grayscale value of the first target sub-image, thereby eliminating the flicker problem with the display panel when displaying low grayscale images, and improving display quality of the display panel.

Further, after step S102, the display compensation method further includes:

Determining the sub-images whose original grayscale value is greater than the grayscale threshold value as a second target sub-image. The original grayscale value of the second target sub-image is greater than the grayscale threshold value. Therefore, in the VAC technologies, only a slight flicker problem occurs in the second target sub-image. At this time, flickering of an image will not be noticed by users, so that the display quality of the display panel will not be adversely affected.

Determining any of the pixel units 10 corresponding to the second target sub-image as a second target pixel unit.

Displaying the second target sub-image through high grayscale subpixels and low grayscale subpixels included in the second target pixel unit, wherein the high grayscale subpixels each have a grayscale value greater than the original grayscale value of the second target sub-image, and the low grayscale subpixels each have a grayscale value less than the original grayscale value of the second target sub-image.

That is, the VAC technologies are employed to perform viewing angle adjustment on the second target sub-image having the original grayscale value greater than the grayscale threshold value, which helps increase visual angles of the second target sub-image, thereby improving an overall visual angle of the display panel.

When the original grayscale value of the sub-image corresponding to the pixel unit 10 is greater than the grayscale threshold value, part of the subpixels of the pixel unit 10 exhibits a high grayscale greater than the original grayscale value, and the other part exhibits a low grayscale less than the original grayscale value.

Further, each of the pixel units 10 has four subpixels including the subpixel 11, the subpixel 12, the subpixel 13, and the subpixel 14.

The step of displaying the second target sub-image through the high grayscale subpixels and the low grayscale subpixels included in the second target pixel unit includes: determining two of the subpixels of the second target pixel unit as the high grayscale subpixels, that is, the subpixel 11 and the subpixel 12 are the high grayscale subpixels; and determining another two of the subpixels of the second target pixel unit as the low grayscale subpixels, that is, the subpixel 13 and the subpixel 14 are the low grayscale subpixels.

Further, after step S102, the display compensation method further includes:

Detecting each of the sub-images of the pending image whose original grayscale value is less than or equal to the grayscale threshold value, determining the pending image including the sub-images each having the original grayscale value less than or equal to the grayscale threshold value as a low grayscale image, and displaying the sub-images of the low grayscale image through each of the subpixels of the pixel units 10 corresponding to the low grayscale image, wherein the grayscale value of each of the subpixels of the pixel units is equal to the original grayscale value of a corresponding one of the sub-images of the low grayscale image.

The embodiment of the present application does not perform viewing angle adjustment through the VAC technologies on the low grayscale image including the sub-images each having the original grayscale value less than or equal to the grayscale threshold value, but directly sets the grayscale value of each of the subpixels to be equal to the original grayscale value of the low grayscale image, thereby eliminating the flicker problem with the display panel when displaying low grayscale images, and improving the display quality of the display panel.

Further, after step S102, the display compensation method further includes:

Detecting whether the pending image includes at least one of the sub-images whose original grayscale value is greater than the grayscale threshold value, determining the pending image including the at least one of the sub-images having the original grayscale value greater than the grayscale threshold value as a high grayscale image, and displaying the sub-images of the high grayscale image through high grayscale subpixels and low grayscale subpixels of the pixel units 10 corresponding to the high grayscale image, wherein the high grayscale subpixels each have a grayscale value greater than the original grayscale value of each of the sub-images of the high grayscale image, and the low grayscale subpixels each have a grayscale value less than the original grayscale value of each of the sub-images of the low grayscale image.

Optionally, each of the pixel units 10 has four subpixels including the subpixel 11, the subpixel 12, the subpixel 13, and the subpixel 14. The step of displaying the sub-images of the high grayscale image through the high grayscale subpixels and the low grayscale subpixels of the pixel units 10 corresponding to the high grayscale image includes: determining two of the subpixels of each of the pixel units 10 as the high grayscale subpixels, and determining another two of the subpixels of each of the pixel units 10 as the low grayscale subpixels. For example, the subpixel 11 and the subpixel 12 are the high grayscale subpixels, and the subpixel 13 and the subpixel 14 are the low grayscale subpixels.

The embodiment uses the VAC technologies to perform viewing angle adjustment on the high grayscale image having the original grayscale value greater than the grayscale threshold value, thereby increasing visual angles in displaying the high grayscale image.

Accordingly, the display compensation method provided by the embodiment includes determining the sub-images of the pending image whose original grayscale value is less than or equal to the grayscale threshold value as the first target sub-image, determining the sub-images whose original grayscale value is greater than the grayscale threshold as the second target sub-image, and displaying the first target sub-image through the first target pixel unit, wherein the grayscale value of each of the subpixels of the first target pixel unit is equal to the original grayscale value of the first target sub-image. The second target sub-image is displayed through the second target pixel unit, wherein the grayscale value of each of the high grayscale subpixels of the second target pixel unit is greater than the original grayscale value of the second target sub-image, and the grayscale value of each of the low grayscale subpixels of the second target pixel unit is less than the original grayscale value of the second target sub-image. The technical features in the above-mentioned embodiment of the present application can eliminate the flicker problem with the display panel when displaying low grayscale images, and increasing visual angles of the display panel in displaying high grayscale images, thereby improving the overall display quality of the display panel.

Figure 3:
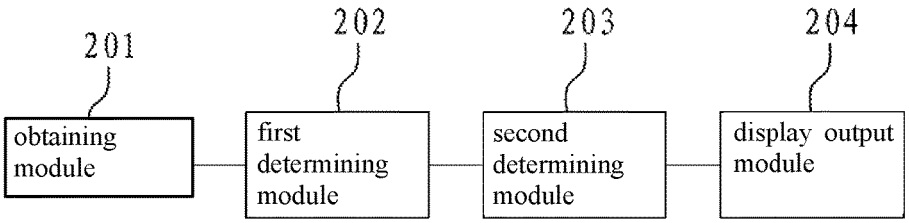
FIG. 3 is a schematic structural view of a first type of a display compensation device provided by an embodiment of the present application.

An embodiment of the present application further provides a display compensation device. Please refer to FIG. 3, which is a schematic structural view of a first type of a display compensation device provided by an embodiment of the present application. The display compensation device is used in a display panel. The display panel may be the display panel shown in FIG. 1 and includes a plurality of pixel units 10 each including a plurality of subpixels.

The display compensation device includes an obtaining module 201, a first determining module 202, a second determining module 203, and a display output module 204.

The obtaining module 201 is configured to obtain original grayscale values of sub-images included in a pending image corresponding to the pixel units 10.

The first determining module 202 is configured to determine the sub-images whose original grayscale value is less than or equal to a grayscale threshold value as a first target sub-image.

The second determining module 203 is configured to determine any of the pixel units 10 corresponding to the first target sub-image as a first target pixel unit.

The display output module 204 is configured to display the first target sub-image through each of the subpixels of the first target pixel unit, wherein each of the subpixels of the first target pixel unit has a grayscale value equal to the original grayscale value of the first target sub-image.

In one embodiment, the first determining module 202 is further configured to determine the sub-images whose original grayscale value is greater than the grayscale threshold value as a second target sub-image.

The second determining module 203 is further configured to determine any of the pixel units 10 corresponding to the second target sub-image as a second target pixel unit.

The display output module 204 is further configured to display the second target sub-image through high grayscale subpixels and low grayscale subpixels included in the second target pixel unit, wherein the high grayscale subpixels each have a grayscale value greater than the original grayscale value of the second target sub-image, and the low grayscale subpixels each have a grayscale value less than the original grayscale value of the second target sub-image.

In one embodiment, a number of the subpixels of each of the pixel units is four. The display output module 204 is further configured to determine two of the subpixels of the second target pixel unit as the high grayscale subpixels, and to determine another two of the subpixels of the second target pixel unit as the low grayscale subpixels.

In one embodiment, the grayscale threshold value is equal to a grayscale value of 16. The first determining module 202 is further configured to compare a magnitude relationship between the original grayscale values of the sub-images and the grayscale threshold value, and to determine the sub-images whose original grayscale value is less than or equal to the grayscale value of 16 as the first target sub-image.

Figure 4:
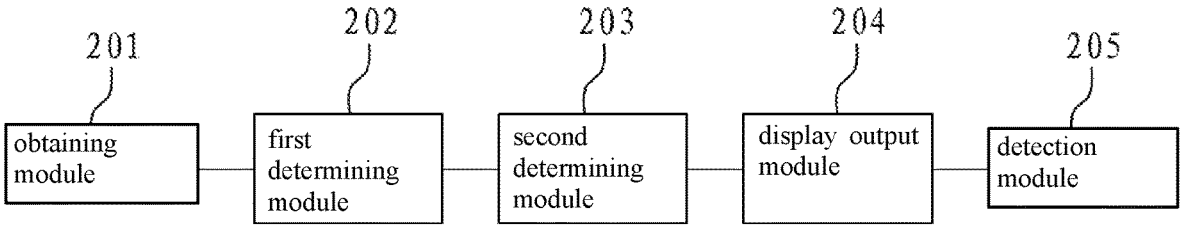
FIG. 4 is a schematic structural view of a second type of the display compensation device provided by the embodiment of the present application.

In one embodiment, please refer to FIG. 4, which is a schematic structural view of a second type of the display compensation device provided by the embodiment of the present application. Based on the display compensation device shown in FIG. 3, the display compensation device further includes a detection module 205.

The detection module 205 is configured to detect whether the pending image includes the sub-images each having the original grayscale value less than or equal to the grayscale threshold value, and to determine the pending image including the sub-images each having the original grayscale value less than or equal to the grayscale threshold value as a low grayscale image through the first determining module 202. The display output module 204 is configured to display the sub-images of the low grayscale image through each of the subpixels of the pixel units 10 corresponding to the low grayscale image, wherein the grayscale value of each of the subpixels of the pixel units is equal to the original grayscale value of a corresponding one of the sub-images of the low grayscale image.

In one embodiment, the detection module 205 is further configured to detect whether the pending image includes at least one of the sub-images whose original grayscale value is greater than the grayscale threshold value, and to determine the pending image including the at least one of the sub-images having the original grayscale value greater than the grayscale threshold value as a high grayscale image through the first determining module 202. The display output module 204 is configured to display the sub-images of the high grayscale image through high grayscale subpixels and low grayscale subpixels of the pixel units 10 corresponding to the high grayscale image, wherein the high grayscale subpixels each have a grayscale value greater than the original grayscale value of each of the sub-images of the high grayscale image, and the low grayscale subpixels each have a grayscale value less than the original grayscale value of each of the sub-images of the low grayscale image.

In one embodiment, the display output module 204 is further configured to determine two of the subpixels of each of the pixel units 10 as the high grayscale subpixels, and to determine another two of the subpixels of each of the pixel units 10 as the low grayscale subpixels.

An embodiment of the present application further provides a display panel. The display panel employs the display compensation method provided by the embodiment of the present application for display. Alternatively, the display panel includes the display compensation device provided by the embodiment of the present application. The display panel may be a liquid crystal display panel.

It should be noted that although the application is disclosed as the above specific embodiments, the above-mentioned embodiments are not intended to limit the application. Those of ordinary skill in the art can make various changes and modifications without departing from the scope of this application, and therefore the protection scope of this application is subject to the scope defined by the claims.

What is claimed is:

1. A display compensation method, employed by a display panel, the display panel comprising a plurality of pixel units each comprising a plurality of subpixels, the display compensation method comprising:

obtaining original grayscale values of sub-images included in a pending image corresponding to the pixel units;

determining the sub-images whose original grayscale value is less than or equal to a grayscale threshold value as a first target sub-image;

determining the sub-images whose original grayscale value is greater than the grayscale threshold value as a second target sub-image;

determining any of the pixel units corresponding to the first target sub-image as a first target pixel unit;

determining any of the pixel units corresponding to the second target sub-image as a second target pixel unit;

displaying the first target sub-image through each of the subpixels of the first target pixel unit, wherein each of the subpixels of the first target pixel unit has a grayscale value equal to the original grayscale value of the first target sub-image; and displaying the second target sub-image through high grayscale subpixels and low grayscale subpixels included in the second target pixel unit, wherein each of the high grayscale subpixels has a grayscale value greater than the original grayscale value of the second target sub-image, and each of the low grayscale subpixels has a grayscale value less than the original grayscale value of the second target sub-image.

2. The display compensation method of claim 1, wherein each of the pixel units comprises four subpixels, and the displaying the second target sub-image through the high grayscale subpixels and the low grayscale subpixels included in the second target pixel unit further comprises:

determining two of the subpixels of the second target pixel unit as the high grayscale subpixels; and determining another two of the subpixels of the second target pixel unit as the low grayscale subpixels.

3. The display compensation method of claim 1, wherein after the determining the sub-images whose original grayscale value is less than or equal to the grayscale threshold value as the first target sub-image, the display compensation method further comprises:

detecting each of the sub-images of the pending image whose original grayscale value is less than or equal to the grayscale threshold value; and determining the pending image comprising the sub-images each having the original grayscale value less than or equal to the grayscale threshold value as a low grayscale image.

4. The display compensation method of claim 3, wherein after the determining the pending image comprising the sub-images each having the original grayscale value less than or equal to the grayscale threshold value as the low grayscale image, the display compensation method further comprises:

displaying the sub-images of the low grayscale image through each of the subpixels of the pixel units corresponding to the low grayscale image, wherein the grayscale value of each of the subpixels of the pixel units is equal to the original grayscale value of a corresponding one of the sub-images of the low grayscale image.

5. The display compensation method of claim 4, wherein after the determining the sub-images whose original grayscale value is less than or equal to the grayscale threshold value as the first target sub-image, the display compensation method further comprises:

detecting whether the pending image comprises at least one of the sub-images whose original grayscale value is greater than the grayscale threshold value; and determining the pending image comprising at least one of the sub-images having the original grayscale value greater than the grayscale threshold value as a high grayscale image.

6. The display compensation method of claim 5, wherein after the determining the pending image comprising the at least one of the sub-images having the original grayscale value greater than the grayscale threshold value as the high grayscale image, the display compensation method further comprises:

displaying the sub-images of the high grayscale image through high grayscale subpixels and low grayscale subpixels of the pixel units corresponding to the high grayscale image, wherein each of the high grayscale subpixels has a grayscale value greater than the original grayscale value of each of the sub-images of the high grayscale image, and each of the low grayscale subpixels has a grayscale value less than the original grayscale value of each of the sub-images of the low grayscale image.

7. The display compensation method of claim 6, wherein a number of the subpixels of each of the pixel units is four, and the displaying the sub-images of the high grayscale image through the high grayscale subpixels and the low grayscale subpixels of the pixel units corresponding to the high grayscale image further comprises:

determining two of the subpixels of each of the pixel units as the high grayscale subpixels; and determining another two of the subpixels of each of the pixel units as the low grayscale subpixels.

8. The display compensation method of claim 1, wherein the grayscale threshold value is equal to a grayscale value of 16, and the determining the sub-images whose original grayscale value is less than or equal to the grayscale threshold value as the first target sub-image comprises:

comparing a magnitude relationship between the original grayscale values of the sub-images and the grayscale threshold value; and determining the sub-images whose original grayscale value is less than or equal to the grayscale value of 16 as the first target sub-image.

9. A display compensation device, used in a display panel, the display panel comprising a plurality of pixel units each comprising a plurality of subpixels, the display compensation device comprising:

an obtaining module configured to obtain original grayscale values of sub-images included in a pending image corresponding to the pixel units;

a first determining module configured to determine the sub-images whose original grayscale value is less than or equal to a grayscale threshold value as a first target sub-image, and further configured to determine the sub-images whose original grayscale value is greater than the grayscale threshold value as a second target sub-image;

a second determining module configured to determine any of the pixel units corresponding to the first target sub-image as a first target pixel unit, and further configured to determine any of the pixel units corresponding to the second target sub-image as a second target pixel unit; and a display output module configured to display the first target sub-image through each of the subpixels of the first target pixel unit, wherein each of the subpixels of the first target pixel unit has a grayscale value equal to the original grayscale value of the first target sub-image, and further configured to display the second target sub-image through high grayscale subpixels and low grayscale subpixels included in the second target pixel unit, wherein each of the high grayscale subpixels has a grayscale value greater than the original grayscale value of the second target sub-image, and each of the low grayscale subpixels has a grayscale value less than the original grayscale value of the second target sub-image.

10. The display compensation device of claim 9, further comprising a detection module configured to detect whether the pending image comprises the sub-images each having the original grayscale value less than or equal to the grayscale threshold value.

11. The display compensation device of claim 9, wherein a number of the subpixels of each of the pixel units is four, and the display output module is further configured to determine two of the subpixels of the second target pixel unit as the high grayscale subpixels, and to determine another two of the subpixels of the second target pixel units as the low grayscale subpixels.

12. The display compensation device of claim 11, wherein the grayscale threshold value is equal to a grayscale value of 16.

13. A display panel, comprising the display compensation device of claim 9.

* * * * *